US007617607B2

(12) United States Patent
Pennell et al.

(10) Patent No.: US 7,617,607 B2
(45) Date of Patent: Nov. 17, 2009

(54) SHAVING RAZORS AND OTHER HAIR CUTTING ASSEMBLIES

(75) Inventors: Evan Pennell, Hingham, MA (US); Alejandro Lee, Cambridge, MA (US); Vincent Walker, Bridgewater, MA (US); Robert Trotta, Pembroke, MA (US); Kevin Powell, Tadley (GB); John Yuskowski, Boxford, MA (US)

(73) Assignee: The Gillette Company, Boston, MA (US)

( * ) Notice: Subject to any disclaimer, the term of this patent is extended or adjusted under 35 U.S.C. 154(b) by 447 days.

(21) Appl. No.: 10/798,864

(22) Filed: Mar. 11, 2004

(65) Prior Publication Data

US 2005/0039337 A1 Feb. 24, 2005

(30) Foreign Application Priority Data

Jul. 21, 2003 (GB) ..... 0317010.1

(51) Int. Cl.
*B26B 21/14* (2006.01)

(52) U.S. Cl. ..... 30/34.1; 30/50

(58) Field of Classification Search ..... 30/34.1, 30/50, 526, 527, 346.5
See application file for complete search history.

(56) References Cited

U.S. PATENT DOCUMENTS

| | | | |
|---|---|---|---|
| 939,935 | A | 11/1909 | Wilcox |
| 1,290,664 | A | 1/1919 | Russell et al. |
| 1,479,690 | A | 1/1924 | Angst |
| 1,734,554 | A | 11/1929 | Behrman |
| 1,777,914 | A | 10/1930 | Davis |
| 1,821,825 | A | 9/1931 | Zumwalt |
| 1,853,867 | A | 4/1932 | Love |

(Continued)

FOREIGN PATENT DOCUMENTS

| | | |
|---|---|---|
| CH | 416377 | 6/1966 |

(Continued)

OTHER PUBLICATIONS

Photographs of razor product referred to as the Mvltiplex razor and allegedly on sale one year prior to applicant's filing date.

(Continued)

*Primary Examiner*—Stephen Choi
(74) *Attorney, Agent, or Firm*—Fish & Richardson P.C.

(57) ABSTRACT

A shaving razor blade unit including a housing having a primary guard at a front of the housing and a primary cap at an upper surface at a back of the housing, one or more primary shaving blades between the primary guard and the primary cap, a rear wall having a rear exterior surface extending downward from the upper surface at the back of the housing to a terminating surface, and a trimming blade mounted on the rear wall and having a trimming cutting edge extending at least partially beyond the terminating surface inside of an imaginary extension of the rear exterior surface, the rear exterior surface defining a secondary cap for the trimming blade. The back of the housing can include trimming guard including spaced guard segments. The trimming blade, trimming guard and trimming cap can be provided as an assembly that is attached to the rest of the housing. The assembly can include a sheet metal support with a blade welded to the support.

23 Claims, 9 Drawing Sheets

U.S. PATENT DOCUMENTS

| | | | |
|---|---|---|---|
| 1,890,334 | A | 12/1932 | Muros |
| 1,911,996 | A | 3/1933 | Gaieman et al. |
| 1,920,711 | A | 8/1933 | Pelizzola |
| 1,999,060 | A | 4/1935 | Rydner |
| 2,043,124 | A | 6/1936 | Smith et al. |
| 2,052,395 | A | 8/1936 | Geissler |
| 2,078,150 | A | 4/1937 | Masip et al. |
| 2,083,172 | A | 6/1937 | Smith |
| 2,094,240 | A | 9/1937 | Herrick et al. |
| D109,694 | S | 5/1938 | Berk |
| 2,118,498 | A | 5/1938 | Drew |
| 2,132,293 | A | 10/1938 | Harrer |
| 2,141,339 | A | 12/1938 | Bauerle |
| D126,066 | S | 3/1941 | Birrell |
| 2,263,885 | A | 11/1941 | McGauley |
| 2,275,517 | A | 3/1942 | Fay |
| 2,309,549 | A | 1/1943 | Swann |
| D137,220 | S | 2/1944 | Brownback |
| 2,353,599 | A | 7/1944 | Swann et al. |
| D160,536 | S | 10/1950 | Reilly |
| 2,593,307 | A | 4/1952 | Jcobson |
| 2,662,281 | A | 12/1953 | Cerino |
| 2,704,397 | A | 3/1955 | Turgi |
| 2,720,695 | A | 10/1955 | Sabiers |
| 2,807,084 | A | 9/1957 | Harman |
| 2,837,820 | A | 6/1958 | Ostrowski |
| 2,848,806 | A | 8/1958 | Shnitzler et al. |
| 2,863,213 | A | 12/1958 | Rypysc |
| 2,934,776 | A | 5/1960 | Clemens |
| 3,061,926 | A | 11/1962 | Fjeran |
| 3,111,757 | A | 11/1963 | Dubofsky |
| 3,137,939 | A | 6/1964 | Waldeck |
| 3,172,202 | A | 3/1965 | Sooter |
| D204,672 | S | 5/1966 | Glaberson |
| 3,259,978 | A | 7/1966 | Weichselbaum |
| 3,299,508 | A | 1/1967 | Kuhnl |
| 3,358,368 | A | 12/1967 | Kuhnl |
| 3,383,764 | A | 5/1968 | Sachs |
| 3,391,458 | A | 7/1968 | Karr |
| 3,412,465 | A | 11/1968 | Andersen . |
| 3,413,720 | A | 12/1968 | Mullen |
| D215,915 | S | 11/1969 | Bikien |
| D215,995 | S | 11/1969 | Harper |
| D216,657 | S | 2/1970 | Grange |
| D216,658 | S | 2/1970 | Edmondson |
| D217,752 | S | 6/1970 | Barry et al. |
| D219,699 | S | 1/1971 | Poisson |
| 3,593,416 | A | 7/1971 | Edson |
| 3,600,804 | A | 8/1971 | Brows |
| 3,626,591 | A | 12/1971 | Robey |
| 3,703,765 | A | 11/1972 | Perez |
| D228,315 | S | 9/1973 | Glaberson |
| 3,795,955 | A | 3/1974 | Dorian, Jr. |
| 3,795,979 | A | 3/1974 | Perry |
| 3,810,305 | A | 5/1974 | Perry |
| 3,823,471 | A | 7/1974 | Stone |
| D234,648 | S | 3/1975 | Braginetz |
| D239,060 | S | 3/1976 | Rees |
| D239,742 | S | 4/1976 | Rees |
| 3,972,115 | A | 8/1976 | Ross |
| D241,382 | S | 9/1976 | Jones |
| 4,017,970 | A | 4/1977 | Williams |
| 4,270,268 | A | 6/1981 | Jacobson |
| 4,281,456 | A | 8/1981 | Douglass et al. |
| 4,285,124 | A | 8/1981 | Diakonov |
| 4,378,633 | A | 4/1983 | Jacobson |
| 4,378,634 | A | 4/1983 | Jacobson |
| D271,531 | S | 11/1983 | Byrne |
| D271,625 | S | 11/1983 | Gray |
| 4,442,598 | A | 4/1984 | Jacobson |
| 4,446,619 | A | 5/1984 | Jacobson |
| 4,488,357 | A | 12/1984 | Jacobson |
| 4,492,024 | A | 1/1985 | Jacobson |
| 4,493,025 | A | 1/1985 | Bachman et al. |
| 4,498,235 | A | 2/1985 | Jacobson |
| 4,501,066 | A | 2/1985 | Sceberras |
| 4,534,110 | A | 8/1985 | Glass |
| 4,535,537 | A | 8/1985 | Ferraro et al. |
| 4,551,916 | A | 11/1985 | Jacobson |
| 4,573,266 | A | 3/1986 | Jacobson |
| 4,586,255 | A | 5/1986 | Jacobson |
| 4,621,424 | A | 11/1986 | Jacobson |
| 4,809,432 | A | 3/1989 | Schauble |
| 4,831,731 | A | 5/1989 | Elits |
| D303,023 | S | 8/1989 | Sinclair |
| 4,901,437 | A | 2/1990 | Iten |
| 4,903,405 | A | 2/1990 | Halvey |
| D306,915 | S | 3/1990 | Luzenberg |
| D307,334 | S | 4/1990 | Ferraro et al. |
| D310,889 | S | 9/1990 | Comcialdi |
| D312,143 | S | 11/1990 | Schwartz |
| 4,970,784 | A | 11/1990 | Althaus et al. |
| D313,672 | S | 1/1991 | Tiegs |
| 4,989,328 | A * | 2/1991 | Sokoloff ..... 30/34.1 |
| 4,993,154 | A | 2/1991 | Radcliffe |
| 5,018,274 | A | 5/1991 | Trotta |
| D318,142 | S | 7/1991 | Falchi |
| 5,027,511 | A | 7/1991 | Miller |
| 5,029,390 | A | 7/1991 | Reeves |
| 5,063,667 | A | 11/1991 | Jacobson |
| 5,067,238 | A | 11/1991 | Miller et al. |
| 5,113,585 | A | 5/1992 | Rogers et al. |
| D327,550 | S | 6/1992 | Chen et al. |
| 5,157,834 | A | 10/1992 | Chen et al. |
| 5,167,069 | A | 12/1992 | Quinn |
| 5,199,173 | A | 4/1993 | Hegemann et al. |
| 5,205,040 | A | 4/1993 | Werner |
| 5,236,439 | A | 8/1993 | Kozikowski |
| 5,269,062 | A | 12/1993 | Dallaire et al. |
| D343,026 | S | 1/1994 | Dallaire et al. |
| 5,282,814 | A | 2/1994 | Srivastava |
| D346,042 | S | 4/1994 | Chu |
| 5,307,564 | A | 5/1994 | Schoenberg |
| 5,333,383 | A | 8/1994 | Ferraro |
| 5,351,401 | A | 10/1994 | Werner |
| D353,020 | S | 11/1994 | Conti |
| 5,365,881 | A | 11/1994 | Sporn |
| 5,386,750 | A | 2/1995 | Morrison et al. |
| D363,141 | S | 10/1995 | Burout et al. |
| 5,454,164 | A | 10/1995 | Yin et al. |
| 5,458,025 | A | 10/1995 | Neamtu |
| D364,706 | S | 11/1995 | Corcoran |
| D369,437 | S | 4/1996 | Armbruster et al. |
| 5,522,137 | A | 6/1996 | Andrews |
| 5,533,263 | A | 7/1996 | Gilder |
| 5,560,106 | A | 10/1996 | Armbruster et al. |
| 5,575,068 | A | 11/1996 | Pedersen |
| 5,579,580 | A | 12/1996 | Althaus et al. |
| 5,661,907 | A | 9/1997 | Apprille, Jr. |
| 5,687,485 | A | 11/1997 | Shurtleff et al. |
| 5,701,788 | A | 12/1997 | Wilson et al. |
| 5,704,127 | A | 1/1998 | Cordio |
| D392,417 | S | 3/1998 | Gray |
| D392,418 | S | 3/1998 | Gray |
| 5,761,814 | A | 6/1998 | Anderson et al. |
| D396,129 | S | 7/1998 | Gray |
| 5,784,790 | A | 7/1998 | Carson, III et al. |
| D397,512 | S | 8/1998 | Gray |
| 5,787,586 | A | 8/1998 | Apprille, Jr. et al. |
| 5,794,354 | A | 8/1998 | Gilder |
| 5,813,293 | A | 9/1998 | Apprille, Jr. et al. |
| 5,822,869 | A | 10/1998 | Metcalf et al. |
| D403,112 | S | 12/1998 | Engel |
| D404,527 | S | 1/1999 | Gray |

| | | | | |
|---|---|---|---|---|
| 5,865,189 | A | 2/1999 | Andrews | |
| D406,393 | S | 3/1999 | Gray | |
| D407,849 | S | 4/1999 | Gray | |
| D407,850 | S | 4/1999 | Shurtleff | |
| D407,851 | S | 4/1999 | Shurtleff | |
| D408,101 | S | 4/1999 | Shurtleff | |
| 5,915,791 | A | 6/1999 | Yin et al. | |
| 5,918,369 | A | 7/1999 | Apprille, Jr. et al. | |
| 5,956,851 | A | 9/1999 | Apprille, Jr. et al. | |
| D416,108 | S | 11/1999 | Shurtleff et al. | |
| D416,646 | S | 11/1999 | Pinchuk | |
| D417,034 | S | 11/1999 | Shurtleff | |
| 6,009,624 | A | 1/2000 | Apprille, Jr. et al. | |
| 6,026,577 | A | 2/2000 | Ferraro | |
| 6,029,354 | A | 2/2000 | Apprille, Jr. et al. | |
| D422,117 | S | 3/2000 | Motta | |
| RE36,816 | E | 8/2000 | Apprille, Jr. et al. | |
| D429,034 | S | 8/2000 | Shurtleff | |
| D431,680 | S | 10/2000 | Wagstaff | |
| 6,141,875 | A | 11/2000 | Andrews | |
| 6,145,201 | A | 11/2000 | Andrews | |
| 6,173,498 | B1 | 1/2001 | Warrick et al. | |
| 6,185,823 | B1 | 2/2001 | Brown et al. | |
| 6,216,345 | B1 | 4/2001 | Andrews | |
| D444,267 | S | 6/2001 | Gray | |
| D445,958 | S | 7/2001 | Dansreau et al. | |
| D446,884 | S | 8/2001 | Kohring et al. | |
| 6,272,061 | B1 | 8/2001 | Kato et al. | |
| 6,276,061 | B1 | 8/2001 | Rozenkranc | |
| D458,410 | S | 6/2002 | Shepperson | |
| 6,418,623 | B1 | 7/2002 | Marcarelli | |
| 6,449,849 | B1 | 9/2002 | Hackerman | |
| D467,387 | S | 12/2002 | Wonderley | |
| 6,493,950 | B1 * | 12/2002 | Kludjian et al. | 30/526 |
| 6,526,660 | B1 | 3/2003 | MacNeil | |
| 6,598,303 | B2 | 7/2003 | Bosy et al. | |
| 6,601,272 | B2 | 8/2003 | Stvartak et al. | |
| 6,629,475 | B1 | 10/2003 | Neamtu et al. | |
| 6,651,342 | B1 | 11/2003 | Walker, Jr. | |
| 6,675,479 | B1 | 1/2004 | Walker, Jr. et al. | |
| 2001/0003869 | A1 | 6/2001 | Rocha | |
| 2002/0144404 | A1 | 10/2002 | Gilder et al. | |
| 2003/0217469 | A1 | 11/2003 | Coffin | |
| 2004/0055156 | A1 * | 3/2004 | Brown, Jr. | 30/34.1 |
| 2005/0015991 | A1 | 1/2005 | Follo et al. | |
| 2005/0022386 | A1 * | 2/2005 | Macove | 30/50 |

FOREIGN PATENT DOCUMENTS

| | | | |
|---|---|---|---|
| DE | 206980 | | 2/1908 |
| DE | 1949400 | | 9/1969 |
| DE | 37 33 486 | A1 | 4/1989 |
| DE | 43 13 371 | | 10/1993 |
| FR | 2632886 | A | 6/1988 |
| GB | 548648 | | 10/1942 |
| GB | 1 456 141 | | 11/1979 |
| GB | 1 587 317 | | 4/1981 |
| GB | 1591095 | | 6/1981 |
| JP | 49-76885 | | 7/1974 |
| JP | 52-137991 | | 10/1977 |
| JP | 56-43984 | | 4/1981 |
| JP | 3-88467 | | 4/1991 |
| JP | 4-83176 | | 7/1992 |
| JP | 7-506503 | | 7/1995 |
| NL | 7603885 | | 10/1977 |
| WO | WO 94/11163 | | 5/1994 |
| WO | WO 96/01171 | | 1/1996 |
| WO | WO 97/37818 | | 10/1997 |
| WO | WO 97/37819 | | 10/1997 |
| WO | WO 98/05478 | | 2/1998 |
| WO | WO 99/14020 | | 3/1999 |

OTHER PUBLICATIONS

Report of Trip to Wilkinson Sword.

* cited by examiner

SHAVING RAZORS AND OTHER HAIR CUTTING ASSEMBLIES

Under 35 U.S.C. §119, this application claims the benefit of a foreign priority application filed in Great Britain, serial number 0317010.1, filed Jul. 21, 2003. The entire contents of this priority application are incorporated herein by reference.

BACKGROUND OF THE INVENTION

The invention relates to shaving razors and other hair cutting assemblies.

In recent years shaving razors with various numbers of blades have been proposed in the patent literature and commercialized, as described, e.g., in U.S. Pat. No. 5,787,586, which generally describes a type of design that has been commercialized as the three-bladed Mach III razor by The Gillette Company.

Increasing the number of blades on a shaving razor generally tends to increase the shaving efficiency of the razor and provide better distribution of compressive forces on the skin but it can also tend to increase drag forces, reduce maneuverability, and reduce the ability to trim, e.g., sideburns or near the nose. U.S. Pat. No. 6,276,061, which is hereby incorporated by reference, describes locating an extra blade mounted on an angled blade support at the rear of a three-bladed razor for trimming. The patent does not describe how the blade is secured on the housing. The trimming blade is exposed such that it might potentially cut someone handling the cartridge. The patent does not describe skin contact surfaces associated with the trimming blade to control the engagement of the blade with the skin.

SUMMARY OF THE INVENTION

In one aspect, the invention features, in general, a shaving razor blade unit including a housing having a primary guard at a front of the housing and a primary cap at an upper surface at a back of the housing, one or more primary shaving blades between the primary guard and the primary cap, a rear wall having a rear exterior surface extending downward from the upper surface at the back of the housing to a terminating surface, and a trimming blade mounted on the rear wall and having a trimming cutting edge extending at least partially beyond the terminating surface inside of an imaginary extension of the rear exterior surface, the rear exterior surface defining a secondary cap for the trimming blade.

In another aspect the invention features, in general, a shaving razor blade unit including a housing, a primary guard, a primary cap, one or more primary shaving blades, a rear wall at the back of the housing, a trimming blade mounted at the back of the housing and a trimming comb guard at the back of the housing including spaced guard segments.

In another aspect, the invention features, in general a shaving razor blade unit including a housing, a primary guard, a primary cap, one or more primary shaving blades, and a trimming assembly attached to the back of the housing. The trimming assembly includes a trimming blade having a trimming cutting edge and a trimming guard in a predetermined position with respect to the trimming cutting edge to define a trimming blade span and a trimming blade angle.

In another aspect, the invention features, in general a hair cutting element (e.g., at trimming blade assembly to be attached to a shaving razor blade unit) including a blade support made of cut and formed sheet metal, and a blade welded to the blade support, such that the blade support defines a guard for the blade and a cap for the blade.

Particular embodiments of the invention may include one or more of the following features. The trimming guard can include debris removal flow passages extending from a region behind the trimming blade and trimming guard. The blade unit can have one or two or more skin protection structures between the trimming guard and said trimming cutting edge. In some embodiments the rear wall can be integrally formed of the same material as said housing. In some other embodiments the rear wall is on a separate component that is attached to the housing. The housing can be made of plastic and the rear wall can be made of metal. The trimming blade can be mounted on an interior surface of the rear wall. The trimming blade can be welded to the interior surface. The trimming guard can be a trimming comb guard including spaced guard segments. The trimming comb guard can be made of sheet metal that has been cut and formed. The blade unit has an open region behind the blade and between the blade and said housing and the unit has debris removal channels extending upward from the open region. The rear wall can have alignment surfaces with which the trimming cutting edge is aligned. The secondary cap can include a strip providing a shaving aid, e.g., a lubricating strip.

Embodiments of the invention may include one or more of the following advantages. The distance between the primary guard and primary cap, measured in a plane tangential thereto, is greater than the distance between the trimming guard and the trimming cap, measured in a plane tangential thereto. The cutting edge of the trimming blade is recessed with respect to the rear wall of the blade unit so as to avoid cutting of a user's skin during handling of the blade unit. The spaced segments of the comb guard facilitate removal of shaving debris, facilitate trimming of sideburns and other longer hairs, and facilitate providing accurately located guard surfaces. Including a trimming blade and a trimming guard on a common assembly that is attached to a housing of a shaving razor blade unit facilitates accurate positioning of the trimming guard with respect to the trimming blade to provide accurate trimming blade tangent angle and trimming blade span.

Other advantages and features of the invention will be apparent from the following description of particular embodiments and from the claims.

DETAILED DESCRIPTION OF PARTICULAR EMBODIMENTS

Figure 1:
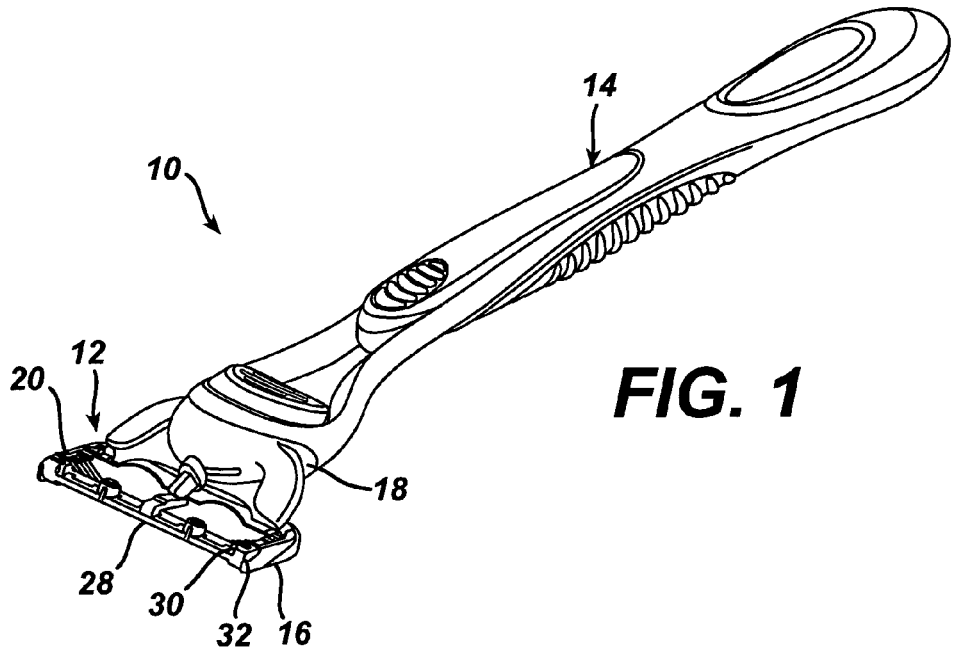
FIG. 1 is a perspective view of a shaving razor.
Figure 2:
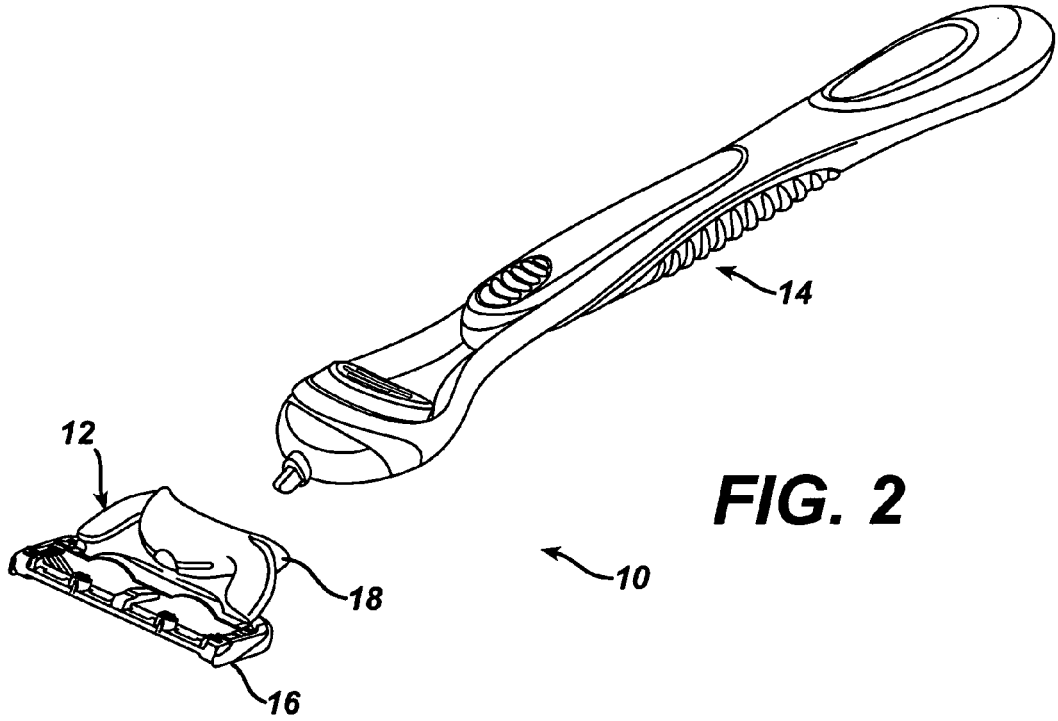
FIG. 2 is a perspective view of the FIG. 1 razor showing its replaceable cartridge separated from its handle.
Figure 15:
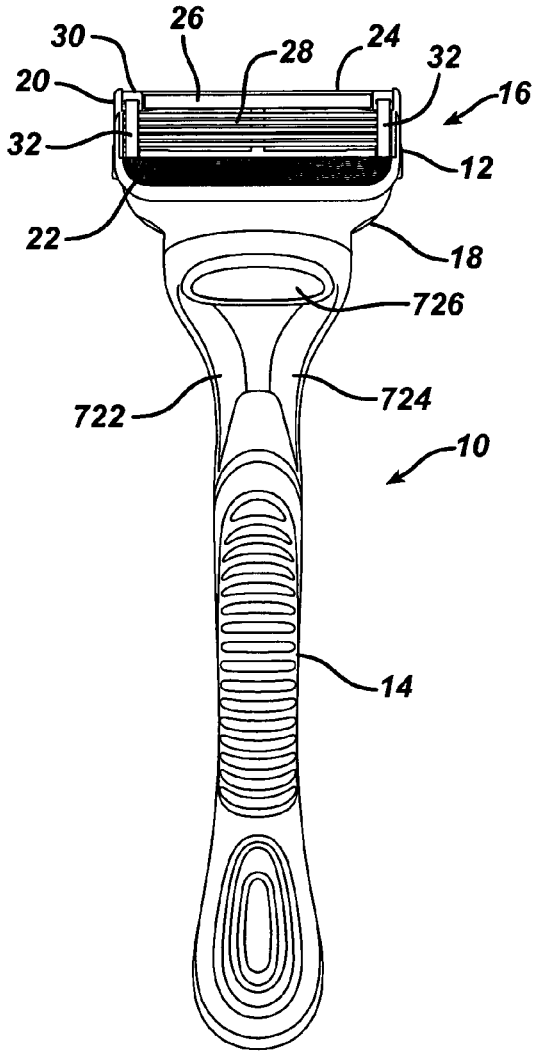
FIG. 15 shows the FIG. 1 razor rotated 90° from the orientation shown in FIG. 14.

Referring to FIGS. 1 and 2, shaving razor 10 includes disposable cartridge 12 and handle 14. Cartridge 12 includes a connecting member 18, which connects to handle 14, and a blade unit 16, which is pivotally connected to connecting member 18. Referring to FIG. 15, blade unit 16 includes plastic housing 20, primary guard 22 at the front of housing 20, cap 24 with lubricating strip 26 at the rear of housing 20, five elongated blades 28 between primary guard 22 and primary cap 24, and trimming blade assembly 30 attached to the rear of housing 20 by clips 32, which also retain blades 28 on housing 20.

Figure 3:
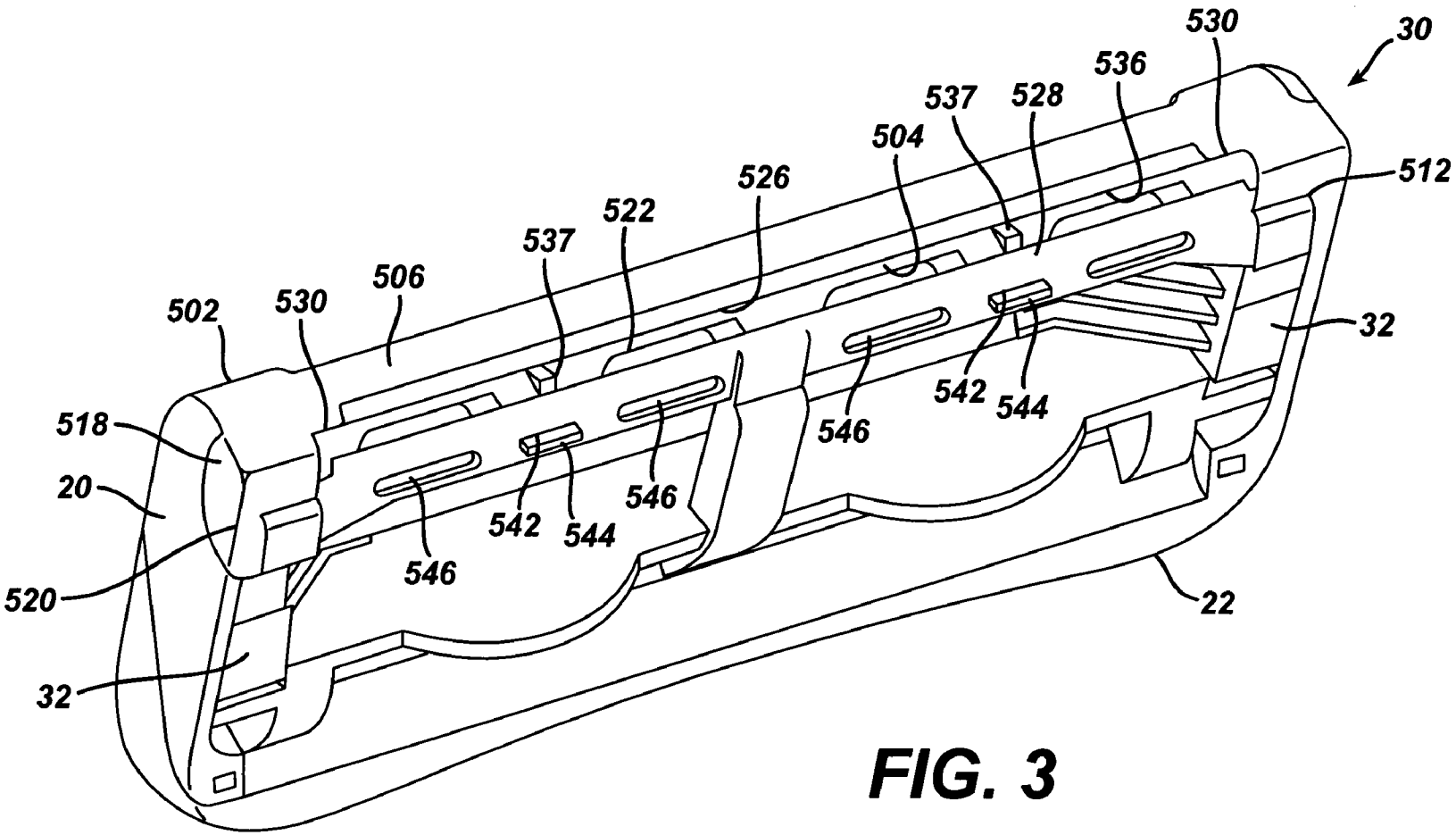
FIG. 3 is perspective view of a blade unit of the FIG. 1 razor with the primary blades removed.

Referring to FIG. 3, trimming blade assembly 30 is secured to the back of housing 20 and includes blade carrier 502 and trimming blade 504 mounted thereon. Blade carrier 502 is made of 0.011" thick stainless steel sheet metal that has been cut and formed to provide structures for attaching to housing 20, supporting trimming blade 504, and defining a trimming guard and trimming cap surfaces.

Referring to FIGS. 3-9, blade carrier 502 has rear wall 506, upper tabs 508, 510 bent to extend forward at the two ends from the top of rear wall 506, lower wall 512 bent to extend forward along the length of rear wall 506 at the bottom of rear wall 506, and two lateral side portions 514, 516, each of which is made of a lateral tab 518 bent to extend forward from a respective side at an end of rear wall 506 and a vertical tab 520 bent to extend upward from a respective end of lower wall 512.

The central portion of rear wall 506 is open at its lower portion, providing a gap 522 that is located between lower, terminating surface 526 of rear wall 506 and trimming guard 528, which extends upward from lower wall 512. Two alignment surfaces 530 are positioned a precise distance from the bottom of terminating surface 526 at the two ends of terminating surface 526. Trimming blade 504 is welded to interior surface 532 of rear wall 506 by thirteen spot welds 534 with cutting edge 536 of trimming blade 504 aligned with alignment surfaces 530. All of the edges around gap 522, which will come in contact with the user's skin, are rounded to provide a radius of curvature of 0.2 mm so that the edges will not be felt by the user.

Figure 10:
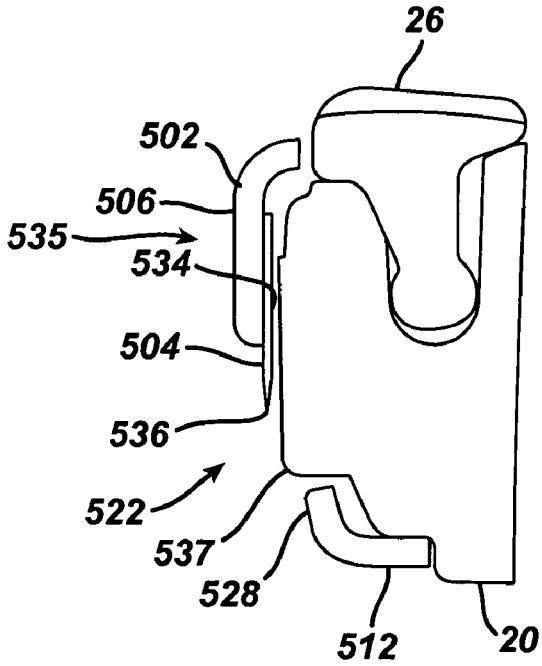
FIG. 10 is a vertical sectional view, taken at 10-10 of FIG. 6, of a portion of the FIG. 3 blade unit.
Figure 11:
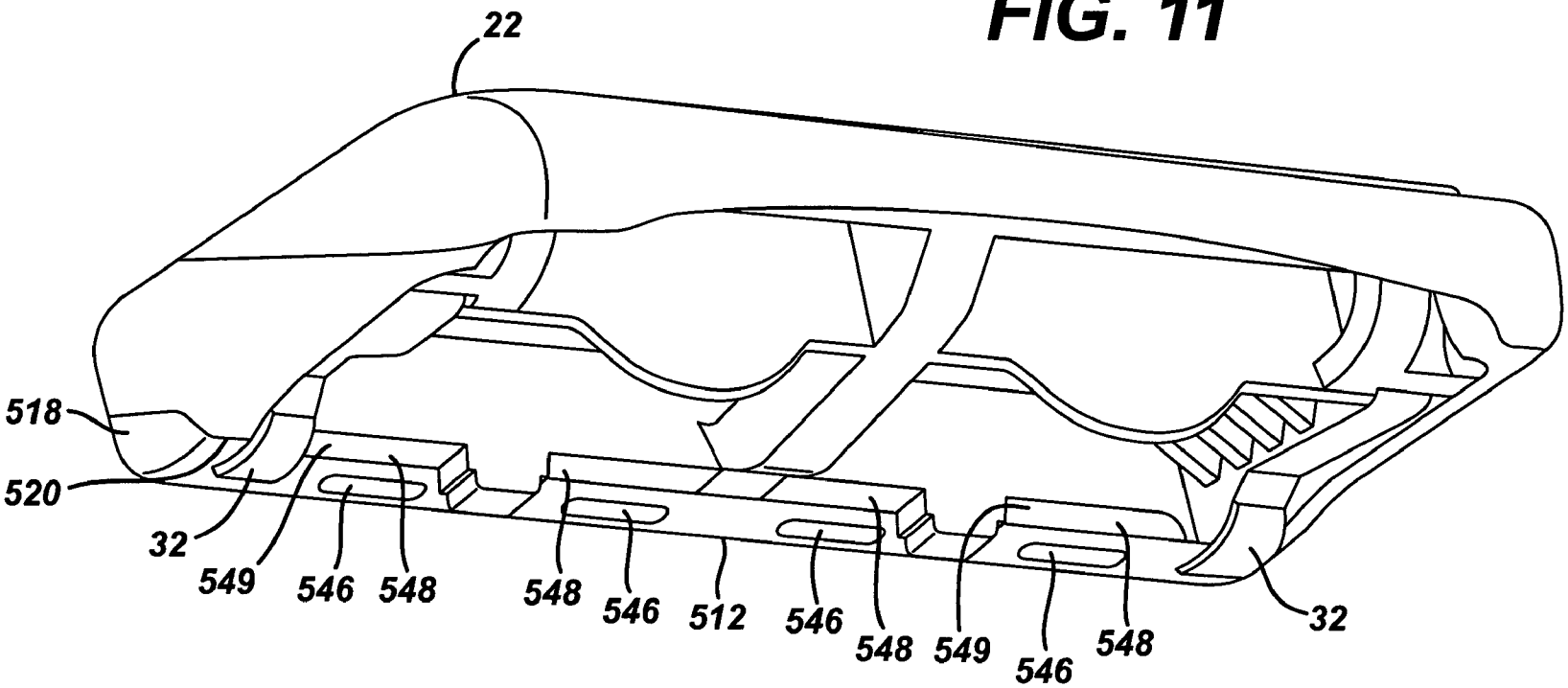
FIG. 11 is a perspective view of the rear of the FIG. 3 blade unit.
Figure 12:
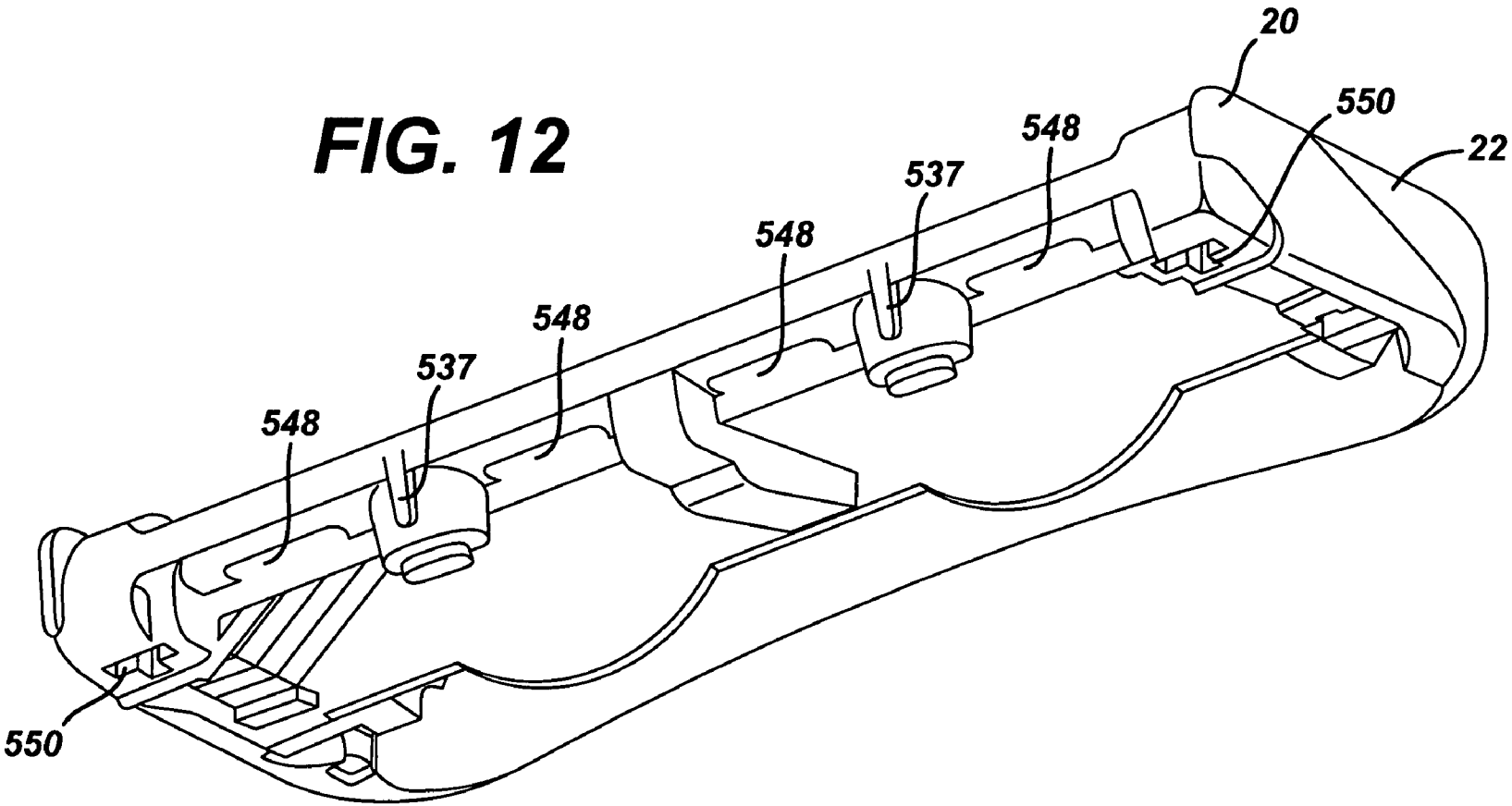
FIG. 12 is a perspective view of the rear of the housing of the FIG. 3 blade unit.

Referring to FIGS. 3, 5-10, gap 522 exposes cutting edge 536 of trimming blade 504. As is perhaps best seen in FIG. 9, rear wall 506 and its lower terminating surface 526 provide a trimming cap 535 for trimming blade 504 and its cutting edge 536 and define the exposure for trimming blade 504. Referring to FIGS. 3 and 10, two skin protection projections 537 spaced part way in from the two ends extend into the space behind a tangent line from trimming cutting edge 536 to trimming guard 528 to limit the amount that the user's skin can bulge into the space between the trimming cutting edge 536 and the trimming guard 528.

Figure 4:
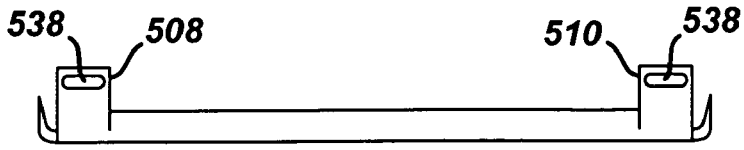
FIG. 4 is a plan view of a trimming assembly of the FIG. 3 blade unit.
Figure 5:
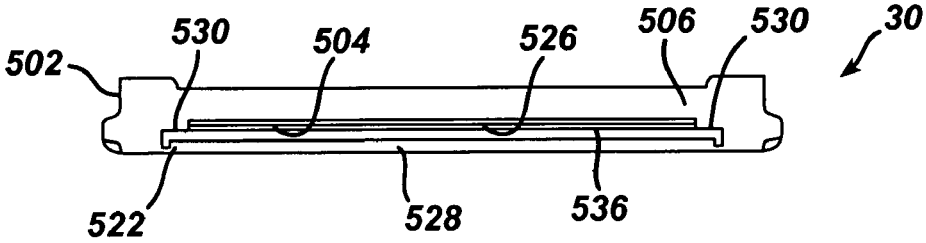
FIG. 5 is a rear elevation of the FIG. 4 trimming assembly.
Figure 6:
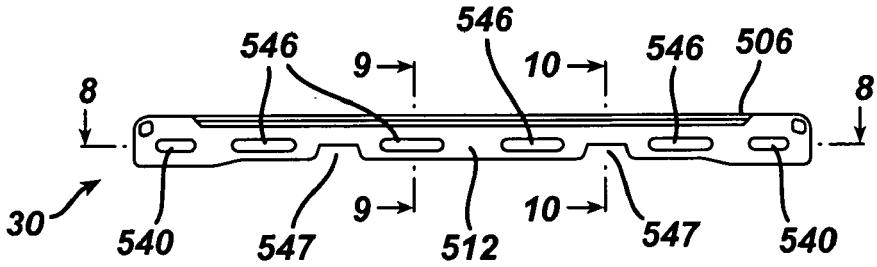
FIG. 6 is a bottom view of the FIG. 4 trimming assembly.
Figure 7:
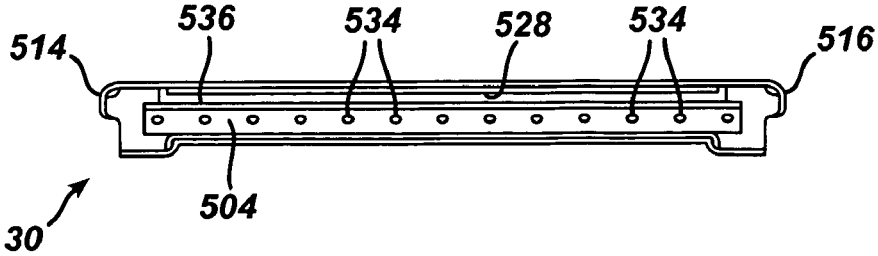
FIG. 7 is a front elevation of the FIG. 4 trimming assembly.
Figure 8:
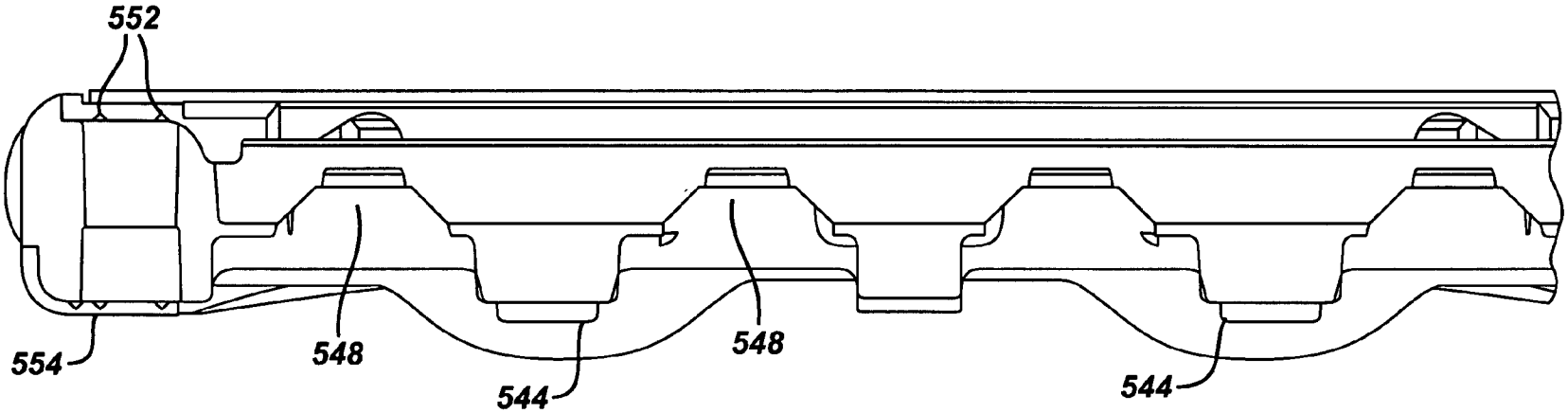
FIG. 8 is a vertical sectional view, taken at 8-8 of FIG. 6, of the housing of the FIG. 3 blade unit.
Figure 9:
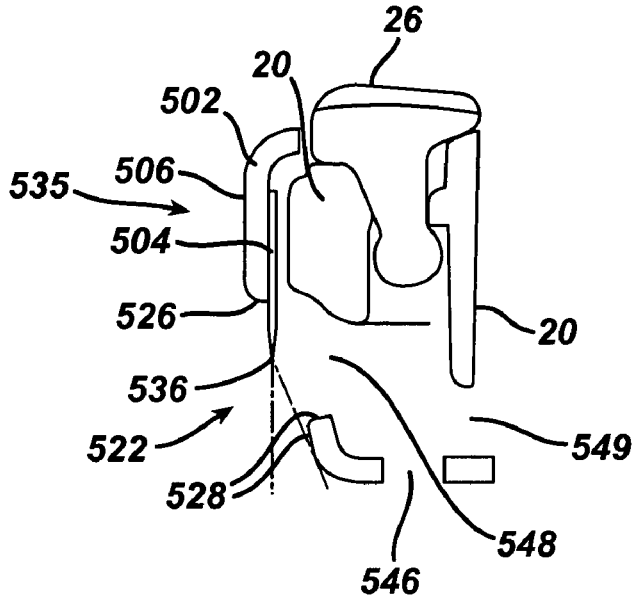
FIG. 9 is a vertical sectional view, taken at 9-9 of FIG. 6, of a portion of the FIG. 3 blade unit.

Referring to FIGS. 4 and 6, upper side tabs 508 and 510 have upper slots 538 and lower wall 512 has aligned slots 540 for receiving clips 32 used to secure trimming blade assembly 30 to housing 20. Referring to FIGS. 3 and 6, lower wall 512 also has recesses 542 for mating with projections 544 on housing 20 to facilitate aligning and retaining assembly 30 in proper position on housing 20.

Referring to FIGS. 3, 6, 8, 9, 11, 12, lower wall also has four debris removal slots 546 that are aligned with four recessed debris removal passages 548 in housing 20 to permit removal of shaving debris from the region behind and below cutting edge 536 during shaving.

In manufacture, blade carrier 506 is cut and formed from sheet metal. Trimming blade 504 is then placed against interior surface 532 with cutting edge 536 aligned with alignment surfaces 530 with an automated placement member, and then secured to interior surface 532 by spot welds 534, with trimming cutting edge 56 in precise position with respect to trimming guard 528 and trimming cap 534. Trimming assembly 30 is then placed on the back of housing 20 by sliding it forward over the rear of housing 20 with recesses 542 on lower wall 512 aligned with projections 544 on housing 20. At the same time, upper crush bumps 552 and lower crush bumps 554 on housing 20 (FIG. 8) are deformed by compression applied between upper tabs 508, 510 and lower wall 512 when assembly 30 is moved forward onto the back of housing 20. Assembly 30 is then secured to housing 20 by clips 32, which pass through upper slots 538 and lower slots 540 on blade carrier 506 and aligned slots 550 through housing 20.

In use, the shaver rotates handle 14 180° from the position in which it is usually gripped such that the thumb is on finger pad 726 (FIGS. 14 and 15) on the side near primary guard 22, and moves the rear of the blade unit toward skin area to be shaved with trimming blade 504 in alignment with the edge of the hairs to be trimmed, e.g., at a location desired for a clean bottom edge of side bums or an edge of a mustache or beard or under a shaver's nose when shaving hairs in this otherwise difficult-to-shave location. The blade unit 16 is located at its stop position with respect to connecting member l8, and thus does not pivot as the user presses the rear of the blade unit 16 and cutting edge 536 against the skin and then moves it laterally over the skin to trim hairs. Cut hairs and other shaving debris that are directed to the region behind cutting edge 536 during trimming pass through debris removal passages 548 in housing 20 and aligned debris removal slots 546 in lower wall during trimming and the entire region and the debris removal passages and slots are easily cleared during rinsing in water, e.g., between shaving or trimming strokes. The cut hairs and shaving debris can also pass through passages 549 behind passages 548 and above the lower wall 512.

The recessed location of cutting edge 536 of the trimming blade 504 with respect to the rear wall 506 of the blade unit avoids cutting of a user's skin during handling of the cartridge 12 and razor 10. Including a trimming blade and a trimming guard on a common assembly that is attached to a housing of a shaving razor blade unit facilitates accurate positioning of the trimming guard with respect to the trimming blade to provide accurate trimming blade tangent angle and trimming blade span.

Figure 13:
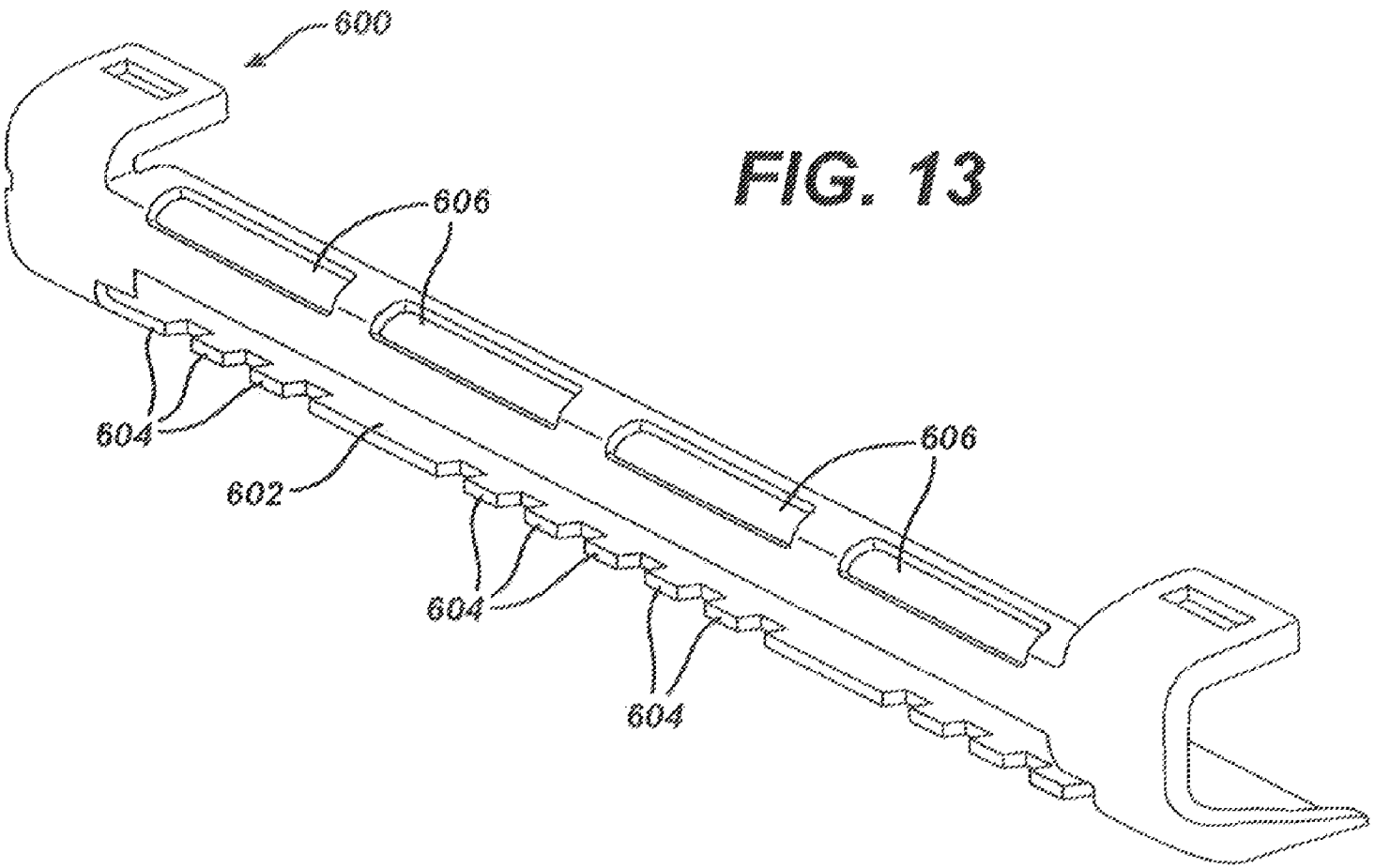
FIG. 13 is a perspective view of a blade carrier component of an alternative embodiment of a trimming assembly with the trimming blade removed.

Referring to FIG. 13, alternative blade support 600 includes a comb guard 602 that has spaced segments 604 to facilitate removal of shaving debris, facilitate trimming of sideburns and other longer hairs, and facilitate providing accurately located guard surfaces during the forming of the guard in the manufacturing process. Blade support 600 also has rinsing openings 606 to permit removal of hairs trapped between trimming blade 504 and the housing 20 (see FIG. 9). In this embodiment, the space between the housing 20 and the blade is made larger than is shown in FIG. 10 to facilitate removal of cut hairs and shaving debris.

Figure 14:
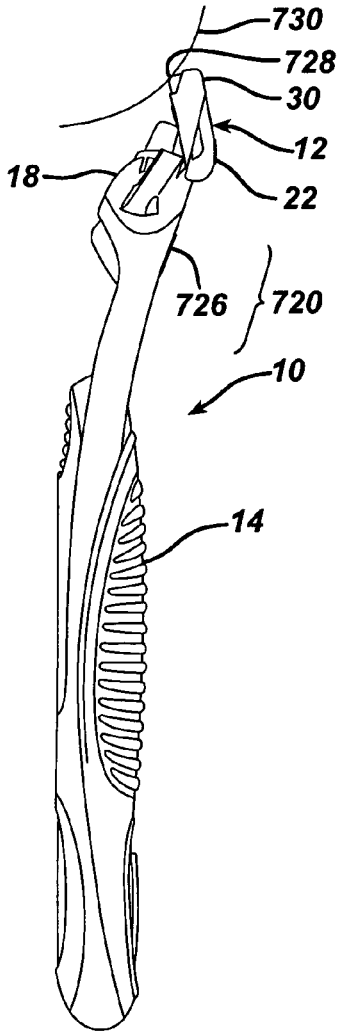
FIG. 14 shows the FIG. 1 razor being applied to the skin for shaving.

Referring to FIGS. 14 and 15, handle 14 includes a single gentle curve 720 at the end being concave on the same side as primary blades 28. Handle 14 is bifurcated into two portions 722, 724, providing an empty region between them to provide access to finger pad 726 located on the concave side of curve 720. The gentle curve 720 on the same side as the primary blades and finger pad 726 and the access to pad 726 provided by the bifurcated handle permit the user to place a thumb or finger in line with and directly under the trimming blade 504, which is located at corner 728 shown in FIG. 14, when trimming sideburns or other whiskers or hairs on user's skin 730. Finger pad 726 is made of elastomeric material and has projections to provide good enagement. The inner surfaces 732, 734 of portions 722, 724 are relieved to provide access to finger pad 726.

With such a shaving razor, the skin contact area spanned by primary guard 22, primary blades 28, and primary cap 24 can be relatively large, whereas the skin contact area spanned by trimming guard 528, trimming blade 504 and trimming cap 535 at the rear of the blade unit 16 is substantially smaller but nonetheless enables safe use of the blade unit for shaving skin areas constricted by protruding facial features adjacent thereto. Thus the distance between primary guard 22 and primary cap 24, measured in a plane tangential thereto, is greater than the distance between trimming guard 528 and trimming cap 535, measured in a plane tangential thereto. The blade unit 16 also has a passage for through flow of rinsing water to allow effective removal of soap and shaving debris from the underside of the trimming blade 504 so that the performance of the trimming blade 504 will not be impaired by a space on the underside of the blade clogging up. Furthermore because the passage opens at the bottom face, shaving debris will be directed away from the upper face so that cut hairs will not become stuck to and contaminate the skin contact surfaces at the top, such as the surface of a lubricating strip 26 at the primary cap 24.

Other embodiments of the invention are within the scope of the appended claims. For example, the sheet metal blade support and attached blade configuration can be used in other hair cutting applications, with the blade support defining an accurately placed guard and/or a cap for the blade. Also, the trimming cap can be providing with a strip providing a shaving aid, e.g., a lubricating strip.

What is claimed is:

1. A shaving razor blade unit comprising a housing having a primary guard at a front of said housing and a primary cap at an upper surface at a back of said housing, one or more primary shaving blades between said primary guard and said primary cap, and an assembly comprising a blade carrier defining a rear wall having a rear exterior surface extending downward from said upper surface at the back of said housing to a terminating surface, and a trimming blade mounted on said rear wall and having a trimming cutting edge extending at least partially beyond said terminating surface inside of an imaginary extension of said rear exterior surface, said rear exterior surface extending along substantially the entire length of the trimming blade and defining a trimming cap for said trimming blade, wherein said housing is made of plastic, said assembly is mounted on said housing, and said blade carrier is formed from sheet metal.

2. A shaving razor blade unit comprising a housing having a primary guard at a front of said housing and a primary cap at an upper surface at a back of said housing, one or more primary shaving blades between said primary guard and said primary cap, and a trimming assembly attached, as one unitary piece, to the back of said housing, said assembly including a blade carrier and, mounted on the blade carrier, a trimming blade having a trimming cutting edge and a trimming guard in a predetermined position with respect to said trimming cutting edge to define a trimming blade span and a trimming blade angle, wherein said housing is formed of plastic and said blade carrier is formed of sheet metal.

3. The unit of claim 1 further comprising a trimming guard at the back of said housing said trimming guard being located inside of said imaginary extension of said rear exterior surface.

4. The unit of claim 3 wherein said housing has a bottom, said trimming guard includes debris removal flow passages extending from a region behind an imaginary surface extending from said trimming cap to said trimming guard to the bottom of said housing.

5. The unit of claim 1 or 2 further comprising one or more skin protection structures between said trimming guard and said trimming cutting edge.

6. The unit of claim 1 or 2 further comprising two or more skin protection structures between said trimming guard and said trimming cutting edge.

7. The unit of claim 1 wherein said rear wall has an interior surface and said trimming blade is mounted on said interior surface.

8. The unit of claim 7 wherein said blade is welded to said interior surface.

9. The unit of claim 2 wherein said trimming guard is a trimming comb guard including spaced guard segments.

10. The unit of claim 3 wherein said trimming guard is a comb guard including spaced guard segments.

11. The unit of claim 9 or 10 wherein said trimming comb guard is made of sheet metal that has been cut and formed.

12. The unit of claim 1 or 2 wherein said unit has an open region behind said blade and between said blade and said housing and said unit has debris removal channels extending upward from said upon region.

13. The unit of claim 7 wherein said rear wall has alignment surfaces with which said cutting edge is aligned.

14. The unit of claim 1 wherein said trimming cap includes a strip providing a shaving aid.

15. The unit of claim 1 or 2 wherein said back of said housing includes a trimming cap including a strip providing a shaving aid.

16. The unit of claim 1 or 2 wherein there are three or more said primary shaving blades.

17. The unit of claim 1 or 2 wherein there are four or more said primary shaving blades.

18. The unit of claim 1 or 2 wherein there are five or more said primary shaving blades.

19. The element of claim 3 or 4 wherein a primary distance between said primary guard said primary cap, measured in a primary plane tangential thereto, is greater than the distance between said trimming guard and said trimming cap, measured in a trimming plane tangential thereto.

20. The unit of claim 2 wherein said trimming assembly includes trimming cap, and wherein a primary distance between said primary guard and said primary cap, measured in a primary plane tangential thereto, is greater than the distance between said trimming guard and said trimming cap, measured in a trimming plane tangential thereto.

21. The unit of claim 20 wherein said housing has a bottom, said trimming guard includes debris removal flow passages extending from a region behind an imaginary surface extending from said trimming cap to said trimming guard to the bottom of said housing.

22. A shaving razor blade unit comprising a housing having a primary guard at a front of said housing and a primary cap at an upper surface at a back of said housing, one or more primary shaving blades between said primary guard and said primary cap, and an assembly comprising a blade carrier defining a rear wall having a rear exterior surface extending downward from said upper surface at the back of said housing to a termination surface, and a trimming blade mounted on said rear wail and having a trimming cutting edge extending at least partially beyond said terminating surface inside of an imaginary extension of said rear exterior surface, said rear exterior surface extending along substantially the entire length of the trimming blade and defining a trimming cap for said trimming blade.

23. A shaving razor blade unit comprising a housing having a primary guard at a front of said housing and a primary cap at an upper surface at a back of said housing, one or more primary shaving blades between said primary guard and said primary cap, and a trimming assembly attached, as one unitary piece, to the back of said housing, said assembly including a blade carrier and, mounted on the blade carrier, a trimming made having a trimming cutting edge and a trimming guard in a predetermined position with respect to said trimming cutting edge to define a trimming blade span and a trimming blade angle.

* * * * *

UNITED STATES PATENT AND TRADEMARK OFFICE

CERTIFICATE OF CORRECTION

PATENT NO. : 7,617,607 B2
APPLICATION NO. : 10/798864
DATED : November 17, 2009
INVENTOR(S) : Evan Pennell et al.

It is certified that error appears in the above-identified patent and that said Letters Patent is hereby corrected as shown below:

Title page, Item (56) (Other Documents), Delete "Mvltiplex" and insert --Multiplex--, therefor.

Column 6, in claim 3, line 11, delete "housing" and insert --housing,--, therefor.

Column 6, in claim 10, line 34, before "comb", insert --trimming--.

Column 6, in claim 12, line 40, delete "upon" and insert --open--, therefor.

Column 6, in claim 15, line 45, delete "claim 1 or 2" and insert --claim 2--, therefor.

Column 6, in claim 19, line 56, after "guard" insert --and--.

Column 6, in claim 20, line 61, after "includes" insert --a--.

Column 8, in claim 23, line 12, delete "made" and insert --blade--, therefor.

Signed and Sealed this

Twenty-sixth Day of January, 2010

David J. Kappos

David J. Kappos
*Director of the United States Patent and Trademark Office*